United States Patent [19]

La Croce

[11] Patent Number: 4,826,037

[45] Date of Patent: May 2, 1989

[54] FULL OPEN END

[75] Inventor: Leonard T. La Croce, Paramus, N.J.

[73] Assignee: American National Can Company, Chicago, Ill.

[21] Appl. No.: 127,177

[22] Filed: Dec. 1, 1987

[51] Int. Cl.[4] ..... B65D 41/32
[52] U.S. Cl. ..... 220/273
[58] Field of Search ..... 220/269–273

[56] References Cited

U.S. PATENT DOCUMENTS 3,724,709 4/1973 Westphal ..... 220/273
3,989,161 11/1976 Pillnik ..... 220/273

*Primary Examiner*—George T. Hall
*Attorney, Agent, or Firm*—Wallenstein Wagner Hattis & Strampel, Ltd.

[57] ABSTRACT

A full open end includes a score line that defines a removable panel which has a tab and the removable panel secured thereto by an integral rivet. The end has anti-rotation members between the tab to prevent rotation of the tab about the rivet.

5 Claims, 1 Drawing Sheet

FIG. 1
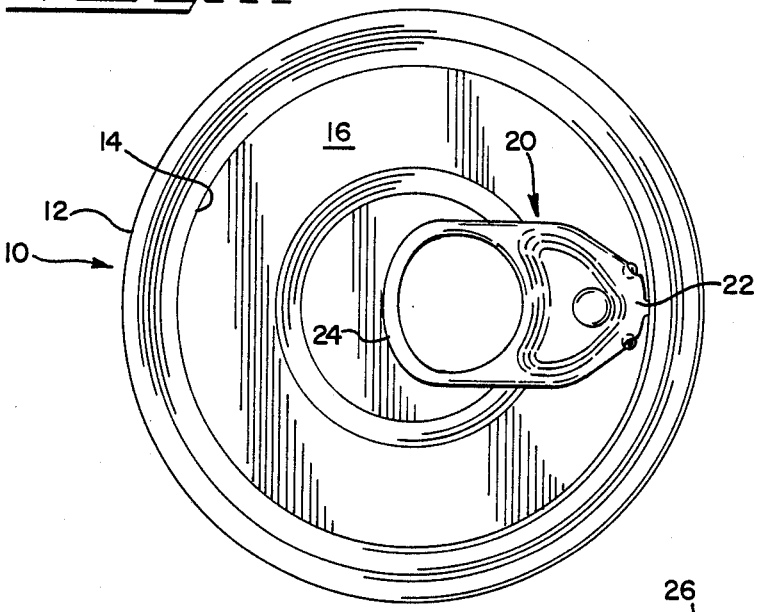
FIG. 2
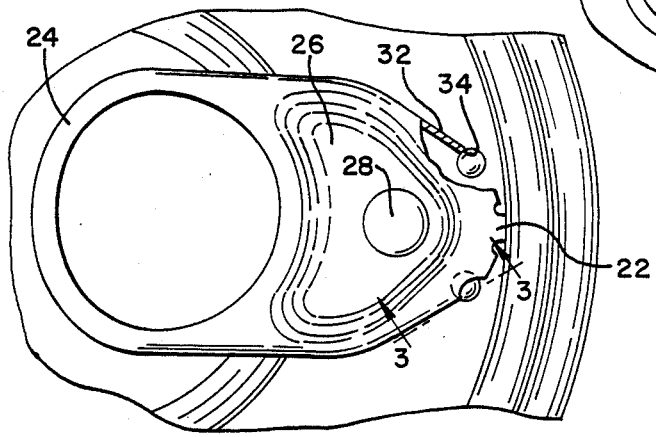
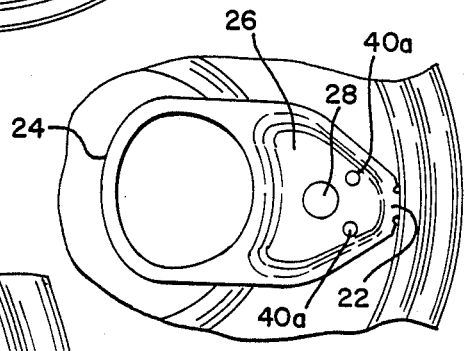
FIG. 4
FIG. 3
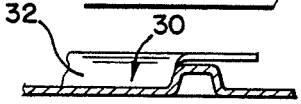

FULL OPEN END

DESCRIPTION

1. Technical Field

The present invention relates generally to closures for containers and more particularly to ends of the full open type.

2. Background Prior Art

Containers having what is commonly referred to as easy open ends have become well known in recent years and now enjoy a considerable measure of consumer acceptability. A full open end of the easy open type normally includes an end closure that is permanently secured to an open end of a container through a conventional double seam. The end has a weakened line adjacent the seam to define a removable panel that includes most of the end. An opening tab is secured by an integral rivet and has a nose portion that is aligned with the score so that pivotal movement of the tab will initiate rupture of the score line and a pulling force on the tab will propagate the rupture of the score line and separate the removable panel from the end.

Various type of products, such as coffee, nuts, candy and other foods are normally packaged in this type of container.

One of the problems that has been encountered is that the tab may be rotated about the rivet during processing and handling so that the nose portion of the tab is no longer aligned with the score line. This makes it difficult or impossible to open the end. Another problem that may be encountered is that the tab may pivot about the circular rivet during the opening process which can result in tearing of the removable panel because of the angular orientation of the tab with respect to the removable panel. In extreme cases, the panel may be torn to an extent that the tab is separated from the removable panel completely and the panel can no longer be removed.

Thus, there remains a need for a simple and inexpensive solution to the problems outlined above.

SUMMARY OF THE INVENTION

According to the present invention, a full open end of the type discussed above incorporates anti-rotation means that will prevent the tab from rotating at all times including the opening process.

More specifically, the full open end of the present invention includes a peripheral flange that is adapted to be seamed to a container and a weakened score line that defines a removable panel in the end with a tab secured to the panel by an integral circular rivet. The rivet has a nose portion at one end and gripping portion or pull ring at the opposite end with the rivet being connected to the tab intermediate opposite ends. The anti-rotation means is located between the rivet and the tip of the nose portion and is located on opposite sides of the rivet. In one specific embodiment, the anti-rotation means consists of a pair of abutments engaging shoulders defined on the tab. The abutments are preferably dimples that can easily be deformed from the removable panel.

In another embodiment, the dimples are simultaneously formed in the tab and the removable panel.

BRIEF DESCRIPTION OF DRAWINGS

FIG. 1 shows a full open end having the present invention incorporated therein;

FIG. 2 is an enlarged view similar to FIG. 1 with parts broken away for purposes of clarity;

FIG. 3 is a cross-sectional view, as viewed along line 3—3 of FIG. 2; and FIG. 4 shows a modified form of the invention.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

FIG. 1 of the drawings discloses a full open end, generally designated by reference numeral 10. End 10 has a peripheral flange 12 that is used to seam the end to a container body. A score line 14 in close proximity to the flange forms a removable panel 16 that encompasses most of the end and has an opening device or tab 20 secured thereto.

The tab 20 has a nose portion 22 at one end and a gripping means 24 at the opposite end. A dish shaped portion or well 26 is located in an intermediate portion of tab 20 and has a opening (not shown). An integral circular rivet 28 is deformed from the removable panel and extends through the opening in the well to secure the tab 20 to the removable panel.

Tab 20 is preferably formed from aluminum and is reinforced throughout its periphery. Gripping means or pull ring 24 is formed by curling the metal as is conventional in the art. The reinforcing means also includes generally U-shaped members 30 on opposite sides of the well 26 and the U-shaped members terminate at a location spaced inwardly of the tip of the nose portion.

The U-shaped reinforcing members have outer legs 32 that extend generally perpendicular to the removable panel and define shoulders 34 at the free ends thereof. The nose portion 22 is thus spaced above the removable panel 16 and its tip is aligned with the score line.

According to the present invention, the end of the present invention incorporates anti-rotation means for preventing the tab from being rotated about the rivet at all times including the opening process. As shown in FIGS. 2 and 3, a pair of dimples or abutment means 40 are deformed from the removable panel 16 and positioned to engage the shoulders 34. It should be noted that the dimples 40 are located between the rivet or connecting means 28 and the tip 36 of the nose. This portion of the tab maintains the same relative position with respect to the adjacent removable panel section at all times even during the removal of the panel from the remainder of the end.

In the opening process, the tab is gripped on the underside of the pull ring 24 is gripped and pivoted upward to initiate the rupture of the score line 14 at the tip of the nose portion. The panel !6 has recessed center portion 50 to allow the fingers or another object to grip the pull ring for such pivotal movement. During this pivotal movement, the entire pull tab will be moved to a position generally perpendicular to the removable panel and the panel will be bent to a corresponding position with the nose portion of the tab. The removable panel has a mustache score line (not shown) behind the rivet to define a line of weakness that is sever during the initial pivotal movement of the tab to vent the container and this score line in the panel defines the bend line for the panel portion that moves with the nose portion of the tab.

After initial rupture of the score line, the pull ring is gripped and a pulling force is applied to sever the remainder of the score line and separate the removable panel from the end. It should be noted that the pulling force is applied generally parallel to the axis of the tab and therefore the bent portion of the removable panel will never be separated from the nose portion of the tab and the dimples will therefore remain engaged with the shoulders at all times throughout the opening process.

Of course, the anti-rotation means need not be circular and could be in the form of elongated beads. Also, the beads could be formed along the outer reinforcing wall 34 and could be located inside or outside this wall and still perform the same function.

A slightly modified form of the invention is shown in FIG. 4. In the modified form of the invention, the anti-rotation means consists of a pair of dimples 40*a* that located on opposite sides of the rivet 28. The dimples are located in the well 26 and the metal in the well is deformed along with the metal in the removable panel.

Further modifications come to mind. For example, if the well where the rivet is located were to be enlarged toward the nose portion, a single dimple could be provided in the well between the nose tip and the rivet.

While the specific embodiments have been illustrated and described, numerous modifications come to mind without significantly departing from the spirit of the invention and the scope of protection is only limited by the scope of the accompanying claims.

I claim:

1. A full open end for a container comprising a panel having a weakened line defining a removable section adapted to be severed to define an opening in said panel, an opening device for severing said weakened line, said opening device having opposite ends and having a permanent connection intermediate opposite ends to said removable section, said opening device having a nose portion at one end and a free end generally aligned with said weakened line and gripping means at an opposite end, said opening means having peripheral reinforcing means terminating in a pair of shoulders between said nose portion and said permanent connection and on opposite sides of said permanent connection, and abutment means on said removable section aligned with said shoulders to prevent rotation of said opening device with respect to said removable section.

2. An end as defined in claim 1, in which said permanent connection includes a circular integral rivet deformed from said removable section.

3. An end as defined in claim 1, in which said opening device is a pull ring having a reinforced peripheral edge terminating on opposite sides of said permanent connection to define said shoulder means.

4. An end for a container comprising a circular panel having a score-line defining a removable section, an opening tab connected by an integral rivet to said removable section, said opening tab having a nose portion at one end and handle means at an opposite end, said opening tab having integral reinforcing means on its periphery with said reinforcing means terminating adjacent said score-line to define a pair of spaced shoulders on opposite sides of said integral rivet, and abutment means integral with said removable section engaging said shoulders to prevent rotation of said tab about said integral rivet during shipment, storage and opening of said end.

5. An end for a container comprising a panel having a weakened line defining a removable section with an opening device connected by a permanent connection to said removable section, said opening device having a nose portion at one end adjacent said weakened line to define a fulcrum point on said panel for said opening device, gripping means at an opposite end of said opening device and reinforcing means integral with said opening device of reinforcing and stiffening said opening device throughout its length to prevent bending of said tab transversely of its length, said reinforcing means terminating in a pair of spaced shoulders adjacent said nose portion, and abutment means engaging said shoulders to prevent rotation of said opening device about said permanent connection during shipment, storage and opening.

* * * * *